US010328954B2

(12) United States Patent
Huck

(10) Patent No.: US 10,328,954 B2
(45) Date of Patent: Jun. 25, 2019

(54) RAILCAR END DOORS AS BRIDGE PLATES

(71) Applicant: Trinity North American Freight Car, Inc., Dallas, TX (US)

(72) Inventor: Kenneth W. Huck, Fairview, TX (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 339 days.

(21) Appl. No.: 15/214,174

(22) Filed: Jul. 19, 2016

(65) Prior Publication Data

US 2018/0022364 A1 Jan. 25, 2018

(51) Int. Cl.
*B61D 3/02* (2006.01)
*B61D 3/18* (2006.01)

(52) U.S. Cl.
CPC ..... *B61D 3/187* (2013.01); *B61D 3/02* (2013.01)

(58) Field of Classification Search
CPC ..... B61D 3/02; B61D 3/187
See application file for complete search history.

(56) References Cited

U.S. PATENT DOCUMENTS 3,421,454 A * 1/1969 Connerat ..... B61D 3/187 105/458
3,556,020 A * 1/1971 Akers ..... B61D 3/187 105/458
3,572,254 A * 3/1971 Slager ..... B61D 3/187 105/458
5,596,936 A * 1/1997 Bullock ..... B61D 3/187 105/458
5,743,192 A * 4/1998 Saxton ..... B60T 13/406 105/355
6,551,039 B1 * 4/2003 Forbes ..... B61D 3/02 105/355
6,895,866 B2 * 5/2005 Forbes ..... B61D 3/18 105/197.05
7,004,079 B2 * 2/2006 Forbes ..... B61D 3/18 105/223
7,055,441 B2 * 6/2006 Jarvis ..... B61D 3/187 105/404
9,550,079 B2 * 1/2017 D'Angelo ..... A62B 1/22
2016/0039432 A1 * 2/2016 Cencer ..... B61D 3/18 29/401.1
2018/0022364 A1 * 1/2018 Huck ..... B61D 3/187 105/8.1

* cited by examiner

*Primary Examiner* — Jason C Smith
(74) *Attorney, Agent, or Firm* — Baker Botts, LLP

(57) ABSTRACT

A railcar system that includes a first railcar comprising a first plurality of decks and a first plurality of end doors adjacent to a respective deck of the first plurality of decks. The railcar system further comprises a second railcar comprising a second plurality of decks and a second plurality of end doors adjacent to a respective deck of the second plurality of decks. Each of the first plurality of end doors and the second plurality of end doors is configurable between a vertical orientation and a horizontal orientation. The railcar system is further configured such that when a first end door of the first plurality of end doors of the first railcar is in its horizontal orientation it aligns with a second end door of the second plurality of end doors of the second railcar when the second end door is in its horizontal orientation.

10 Claims, 8 Drawing Sheets

RAILCAR END DOORS AS BRIDGE PLATES

TECHNICAL FIELD

This disclosure relates generally to railcars, and more specifically to systems and methods for connecting decks of railcars together.

BACKGROUND

In existing railcar system, railcars, such as autoracks, are loaded and unloaded while connected to other railcars. While loading and unloading vehicles, the decks of adjacent railcars are connected to each other to provide a continuous driving surface and support for the vehicles as they transition from one railcar to another. Existing railcar systems may employ bridge plates that span across the gaps between decks of adjacent cars. Bridge plates may be positioned between adjacent railcars and are installed by personnel. Bridge plates may be narrow to minimize weight, which limits the working area for personnel that are standing on the bridge plates while installing or removing bridge plates for upper decks. Bridge plates may provide only a narrow path for personnel to move from one railcar to another. Bridge plates may also be formed from light weight materials to reduce weight. Light weight materials, such as aluminum, may be relatively soft and may become nicked and/or gouged with sharp edges which can be a hazard to personnel working with the bridge plates. Thus, it is desirable to provide a system that allows adjacent railcars to be connected to each other while providing a safe environment for personnel.

SUMMARY

In one embodiment, the disclosure includes a railcar system that includes a first railcar comprising a first plurality of decks disposed at different levels within the first railcar and a first plurality of end doors disposed at a first end of the first railcar. Each of the first plurality of end doors is adjacent to a respective deck of the first plurality of decks. Each of the plurality of first end doors is configurable between a vertical orientation and a horizontal orientation such that each of the first plurality of end doors aligns with its respective deck of the first plurality of decks when in its horizontal orientation. The railcar system further comprises a second railcar comprising a second plurality of decks disposed at different levels within the second railcar and a second plurality of end doors disposed at a first end of the second railcar. Each of the second plurality of end doors is adjacent to a respective deck of the second plurality of decks. Each of the second plurality of end doors is configurable between a vertical orientation and a horizontal orientation such that each of the second plurality of end doors aligns with its respective deck of the second plurality of decks when in its horizontal orientation. The railcar system is further configured such that when a first end door of the first plurality of end doors of the first railcar is in its horizontal orientation it aligns with a second end door of the second plurality of end doors of the second railcar when the second end door is in its horizontal orientation.

In another embodiment, the disclosure includes a railcar configuring method that includes transitioning a first end door at a first end of a first railcar from a vertical orientation to a horizontal orientation. The first end door is adjacent to a first deck of a first plurality of decks disposed within the first railcar. The method further includes transitioning a second end door at a first end of a second railcar from a vertical orientation to a horizontal orientation. The second end door is adjacent to a second deck of a second plurality of decks disposed within the second railcar. The railcar system is configured such that when the first end door is in its horizontal orientation it aligns with the second end door when the second end door is in its horizontal orientation. The method further includes transitioning a third end door at the first end of the first railcar from a vertical orientation to a horizontal orientation. The third door is adjacent to a third deck of the first plurality of decks disposed within the first railcar. The method further includes transitioning a fourth end door at the first end of the second railcar from a vertical orientation to a horizontal orientation. The fourth end door is adjacent to a fourth deck of the second plurality decks disposed within the second railcar. The railcar system is configured such that when the third end door is in its horizontal orientation it aligns with the fourth end door when the fourth end door is in its horizontal orientation.

In yet another embodiment, the disclosure includes an apparatus that includes a plurality of decks disposed at different levels within a railcar and a plurality of end doors disposed at a first end of the railcar. Each of the plurality of end doors is adjacent to a respective deck of the plurality of decks. Each of the end doors is configurable between a vertical orientation and a horizontal orientation such that each of the plurality of end doors aligns with its respective deck of the plurality of decks when in its horizontal orientation. The apparatus is further configured such that when a first end door of the plurality of end doors is in its horizontal orientation it aligns with a second end door of a second railcar when the second end door is in its horizontal orientation.

Various embodiments present several technical advantages, such as end doors that not only secure a railcar, but also may be used as bridge plates to connect adjacent railcars. A railcar may employ a plurality of end doors which can be lowered into a position between adjacent railcars to provide a path between decks of the railcars. The end doors may be the width of the railcar and may provide a wider path between railcars, which may provide addition support for personnel and vehicles. End doors are coupled to railcars which may reduce the amount of work by personnel to connect railcars and may increase the speed and efficiency when connecting railcars. Railcars may no longer have to sacrifice interior space and/or storage that is used to carry removable bridge plates.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments for configuring railcars to use end doors as bridge plates to provide paths between decks of adjacent railcars. End doors of the railcar may be transitioned between a first orientation that prevents access to the decks of the railcar to a second orientation that allows access to the decks of the railcar and forms a portion of a path between adjacent railcars. Using end doors as bridge plates allows decks of railcars to be connected without installing and removing conventional bridge plates, which may improve speed, efficiency, and safety when connecting decks of railcars.

Figure 1:
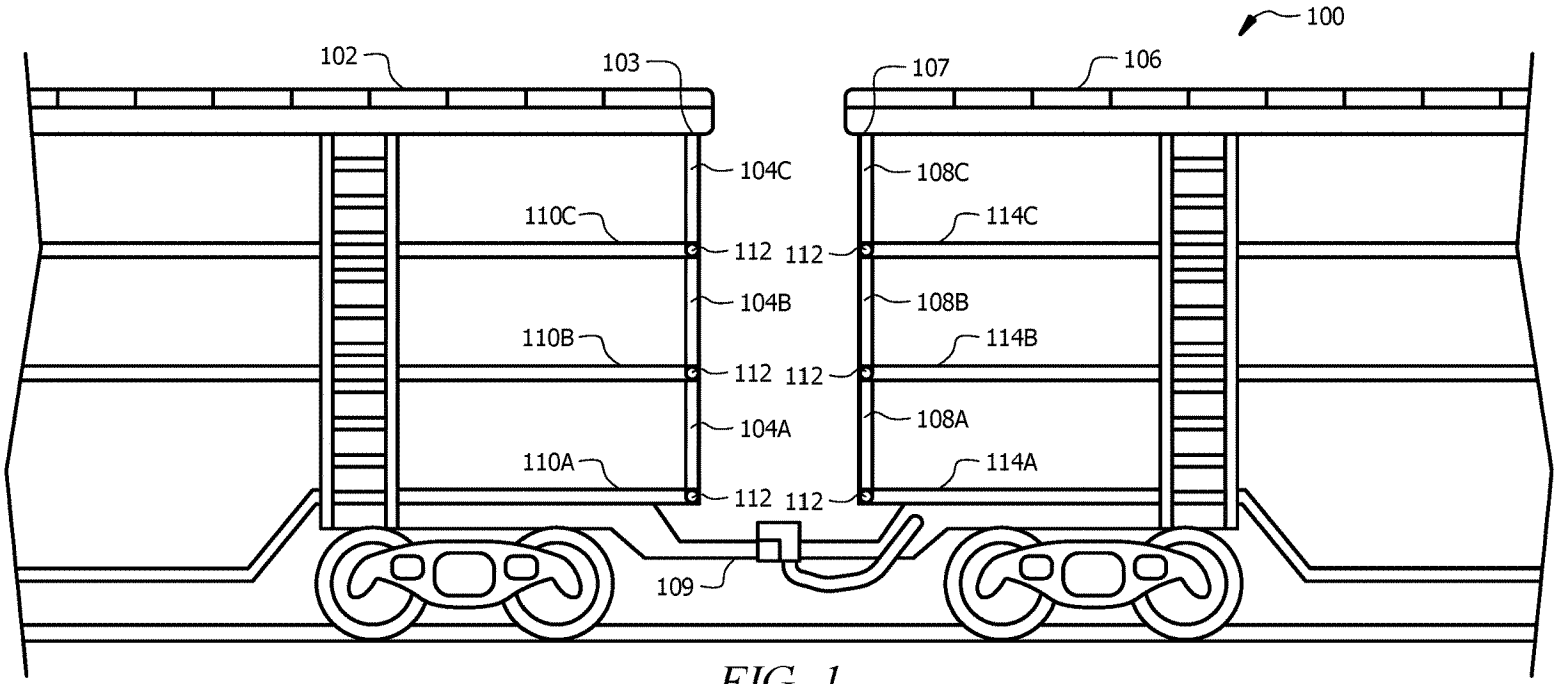
FIG. 1 is a cutaway side view of an embodiment of a railcar system with a first railcar with a first plurality of end doors in a vertical orientation and a second railcar with a second plurality of end doors in a vertical orientation.

FIG. 1 is a cutaway side view of an embodiment of a railcar system 100 with a first railcar 102 with a first plurality of end doors 104A, 104B, and 104C in a vertical orientation and a second railcar 106 with a second plurality of end doors 108A, 108B, and 108C in a vertical orientation. In FIG. 1, the first railcar 102 and the second railcar 106 are configured with the first plurality of end doors 104A-104C and the second plurality of end doors 108A-108C in a vertical orientation which prevents paths between a first plurality of decks 110A, 110B, and 110C of the first railcar 102 and a second plurality of decks 114A, 114B, and 114C of the second railcar 106.

An example of the first railcar 102 and the second railcar 106 includes, but is not limited to, an autorack railcar. An autorack railcar may also be referred to as an auto carrier or a car transporter. In one embodiment, an autorack railcar may be used for transporting automobiles and light trucks, for example, from a manufacturing facility to a distributorship. Vehicles on the first railcar 102 and the second railcar 106 fully or substantially enclosed by continuous side panels, end doors, and a roof that protects the vehicles from severe weather, theft, vandalism, or any other in-transit damage. In FIG. 1, the first railcar 102 and the second railcar 106 are configured as a tri-level autorack railcar. A tri-level autorack railcar comprises three levels for transporting vehicles. In other embodiments, the first railcar 102 and the second railcar 106 may be configured as a bi-level autorack railcar. A bi-level autorack railcar comprises two levels for transporting vehicles.

The first railcar 102 comprises the first plurality of end doors 104A, 104B, and 104C and the first plurality of decks 110A, 110B, and 110C adjacent to the first plurality of end doors 104A, 104B, and 104C, respectively. The first plurality of decks 110A, 110B, and 110C are disposed at different levels within the first railcar 102. The first plurality of decks 110A, 110B, and 110C may each be disposed at any suitable height within the first railcar 102. The first plurality of decks 110A, 110B, and 110C are each configured to support a payload, for example, one or more vehicles.

The first plurality of end doors 104A-104C are disposed at a first end 103 of the first railcar 102, for example, a rear end of the first railcar 102. In one embodiment, the first plurality of end doors 104A-104C may be operably coupled to the first plurality of decks 110A-110C. In another embodiment, the first plurality of end doors 104A-104C may each be operably coupled to the first railcar 102, for example, to the frame or sides of the first railcar 102. The first plurality of end doors 104A-104C may be operably coupled to the first plurality of decks 110A-110C and/or the first railcar 102 using hinges 112. Hinges 112 are configured to allow each of the first plurality of end doors 104A-104C to pivot or rotate about the hinge 112. For example, the hinges 112 are configured to allow the first plurality of end doors 104A-104C to pivot about the hinge 112 to transition between a vertical orientation and a horizontal orientation. Any suitable type of hinges 112 or other coupling mechanisms may be employed as would be appreciated by one of ordinary skill in the art upon viewing this disclosure. In FIG. 1, the first plurality of end doors 104A-104C are shown in a vertical orientation. In the vertical orientation, the first plurality of end doors 104A-104C obstructs access to the first plurality of decks 110A-110C. Examples of at least one of the first plurality of end doors 104A-104C in the horizontal orientation are described in FIGS. 3 and 5.

Similarly, the second railcar 106 comprises the second plurality of end doors 108A, 108B, and 108C and the second plurality of decks 114A, 114B, and 114C adjacent to the second plurality of end doors 108A, 108B, and 108C, respectively. The second plurality of decks 114A, 114B, and 114C are disposed at different levels within the second railcar 106. The second plurality of decks 114A, 114B, and 114C may each be disposed at any suitable position within the second railcar 106. The second plurality of decks 114A, 114B, and 114C are each configured to support a payload, for example, one or more vehicles.

The second plurality of end doors 108A-108C are disposed at a first end 107 of the second railcar 106, for example, a front end of the second railcar 106. In one embodiment, the second plurality of end doors 108A-108C may be operably coupled to the second plurality of decks 114A-114C using hinges 112. In another embodiment, the second plurality of end doors 108A-108C may each be operably coupled to the second railcar 106 using hinges 112. The hinges 112 are configured to allow the second plurality of end doors 108A-108C to pivot about the hinges 112 to transition between a vertical orientation and a horizontal orientation. In FIG. 1, the second plurality of end doors 108A-108C are shown in a vertical orientation. In the vertical orientation, the second plurality of end doors 108A-108C obstructs access to the second plurality of decks 114A-114C. Examples of at least one of the second plurality of end doors 108A-108C in the horizontal orientation are described in FIGS. 3 and 5.

The first railcar 102 and the second railcar 106 may be coupled to each other using railcar linkage 109. Any suitable railcar linkage 109 may be employed to physically couple the first railcar 102 and the second railcar 106 together as would be appreciated by one of ordinary skill in the art upon viewing this disclosure.

Figure 2:
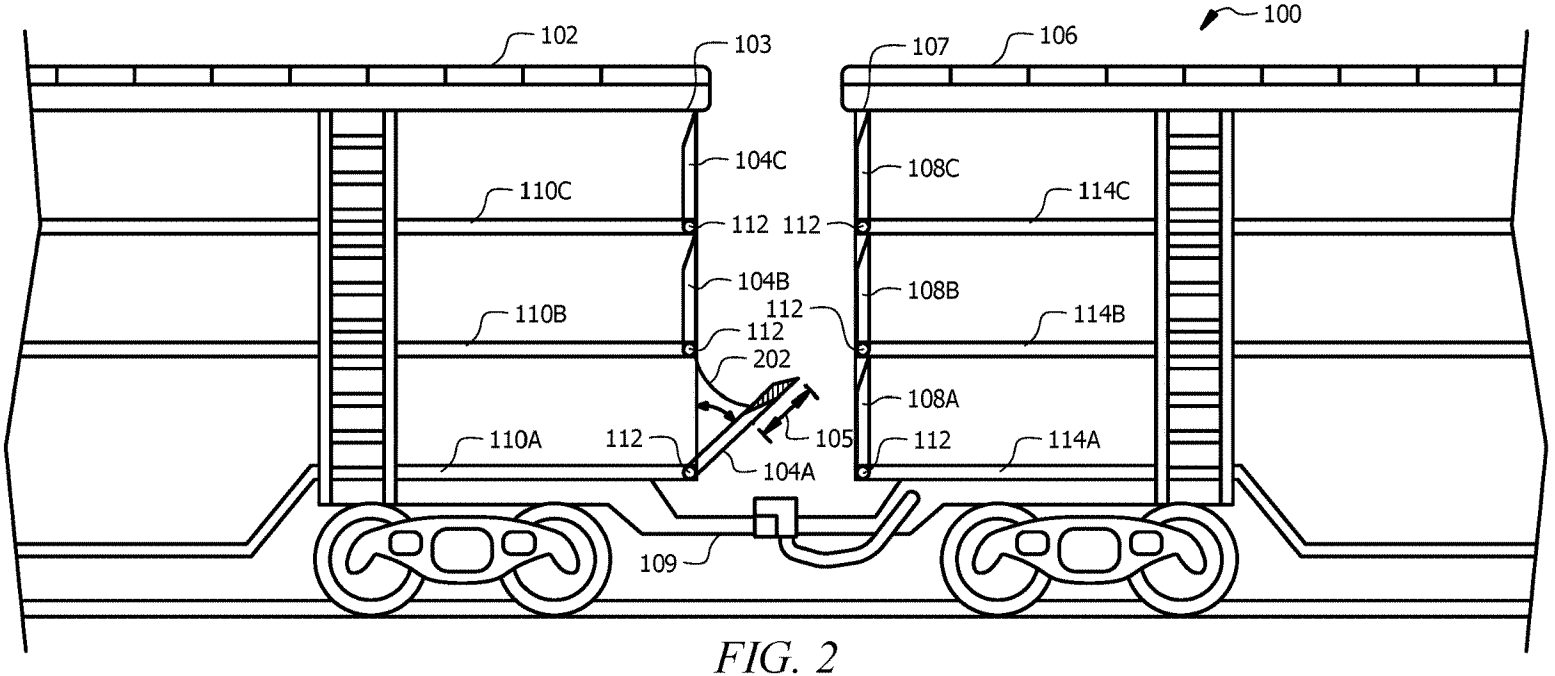
FIG. 2 is a cutaway side view of an embodiment of the first railcar with an end door transitioning from the vertical orientation to a horizontal orientation.

FIG. 2 is a cutaway side view of an embodiment of the first railcar 102 with a first end door 104A from the first plurality of end doors 104A-104C transitioning from the vertical orientation to a horizontal orientation. In FIG. 2, transitioning the first end door 104A from the vertical orientation to a horizontal orientation allows access to a first deck 110A that is adjacent to the first end door 104A. The first end door 104A may be configured to transition from the vertical orientation to the horizontal orientation individually. In other words, the first end door 104 may be transitioned from the vertical orientation to the horizontal orientation without transition other end doors from the first plurality of end doors 104A-104C.

In one embodiment, the first end door 104A has a beveled or sloped edge. For example, the first end door 104A may have a beveled edge configured to interface with a beveled edge of a second end door 108A of the second railcar 106 such that the first end door 104A and the second end door 108A at least partially overlap and/or align when the first end door 104A and the second end door 108A are in their horizontal orientation. An example of the first end door 104A and the second end door 108A in the horizontal orientation is described in FIG. 3.

In one embodiment, the first end door 104A may be a telescopic end door with an adjustable length 105. For example, the first end door 104A may be configured to allow a portion of the first end door 104A to extend to increase the length 105 of the first end door 104A and to retract reduce the length 105 of the first end door 104A.

In one embodiment, the first end door 104A may be operably coupled to the first railcar 102 using a support attachment 202. Support attachment 202 may be configured to support the weight of the first end door 104A as the first end door 104A transitions to the horizontal orientation. Examples of support attachment 202 include, but are not limited to, steel cables and chains.

Figure 3:
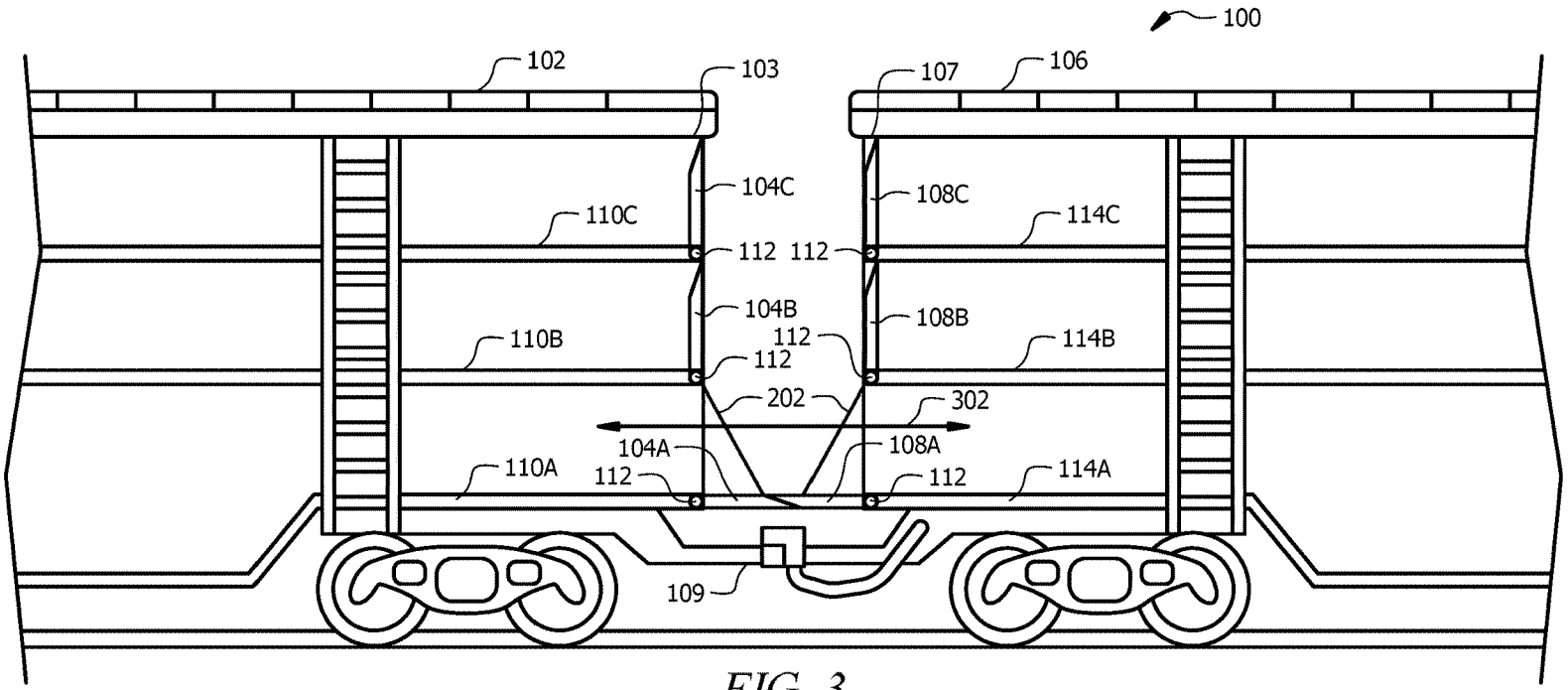
FIG. 3 is a cutaway side view of an embodiment of the first railcar with an end door in the horizontal orientation and the second railcar with an end door in the horizontal orientation.

FIG. 3 is a cutaway side view of an embodiment of the first railcar 102 with an end door 104A in the horizontal orientation and the second railcar 106 with an end door 108A in the horizontal orientation. In FIG. 3, a path is formed between a first deck 110A of the first railcar 102 and a second deck 114A of the second railcar 106 when the first railcar 102 is configured with the first end door 104A in the horizontal orientation and the second railcar 106 is configured with the second end door 108A in the horizontal orientation. The first end door 104A is configured to allow access to the first deck 110A and to form a portion of the path 302 between the first deck 110A of the first railcar 102 and the second deck 114A of the second railcar 106 when the first end door 104A is in its horizontal orientation. Similarly, the second end door 108A is configured to allow access to the second deck 114A of the second railcar 106 and to form a portion of the path between the second deck 114A of the second railcar 106 and the first deck 110A of the first railcar 102 when the second end door 108A is in its horizontal orientation.

The first end door 104A and the second end door 108A are configured to at least partially overlap and/or align when the first end door 104A and the second end door 108A are in their horizontal orientation. For example, the first end door 104A may have a beveled edge configured to interface with a beveled edge of the second end door 108A of the second railcar 106 such that the first end door 104A and the second end door 108A at least partially overlap and/or align when the first end door 104A and the second end door 108A are in their horizontal orientation.

In one embodiment, the first end door 104A may be operably coupled to the first railcar 102 using a support attachment 202 and the second end door 108A may be operably coupled to the second railcar 106 using a support attachment 202 similarly to as described in FIG. 2.

Figure 4:
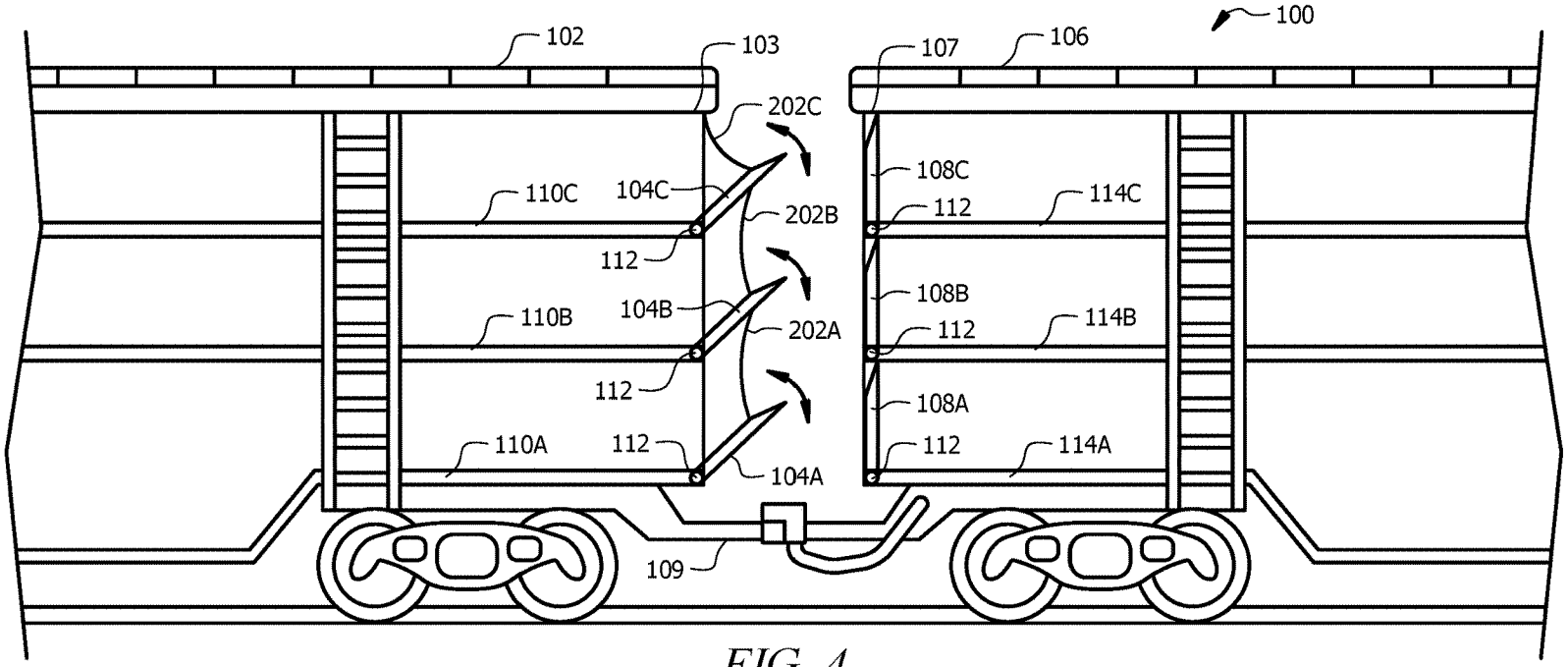
FIG. 4 is a cutaway side view of an embodiment of the first railcar with the first plurality of end doors transitioning from the vertical orientation to the horizontal orientation.

FIG. 4 is a cutaway side view of an embodiment of the first railcar 102 with the first plurality of end doors 104A-104C transitioning from the vertical orientation to the horizontal orientation. In FIG. 4, transitioning the first plurality of end doors 104A-104C from the vertical orientation to the horizontal orientation allows access to the first plurality of decks 110A-110C. In one embodiment, the first plurality of end doors 104A-104C may be configured to transition from the vertical orientation to the horizontal orientation at about the same time. In another embodiment, the first plurality of end doors 104A-104C may each be configured to transition from the vertical orientation to the horizontal orientation individually. In other words, each end door of the first plurality of end doors 104A-104C may be configured to transition from the vertical orientation to the horizontal orientation sequentially one after another. For example, an operator may first transition the first end door 104A from the vertical orientation to the horizontal orientation, then the second end door 104B from the vertical orientation to the horizontal orientation, and then the third end door 104C from the vertical orientation to the horizontal orientation. The operator may transition the first plurality of end doors 104A-104C in any order.

The first plurality of end doors 104A-104C may be configured to employ a plurality of support attachments 202 to support the weight of each of the first plurality of end doors 104A-104C. Each of the first plurality of end doors 104A-104C may be operably coupled to the first railcar 102 and/or to another end door from the first plurality of end doors 104A-104C. For example, a first end door 104A may be operably coupled to a second end door 104B using a first support attachment 202A, the second end door 104B may be operably coupled to a third end door 104C using a second support attachment 202B, and the third end door 104C may be operably coupled to the first railcar 102 using a third support attachment 202C.

Figure 5:
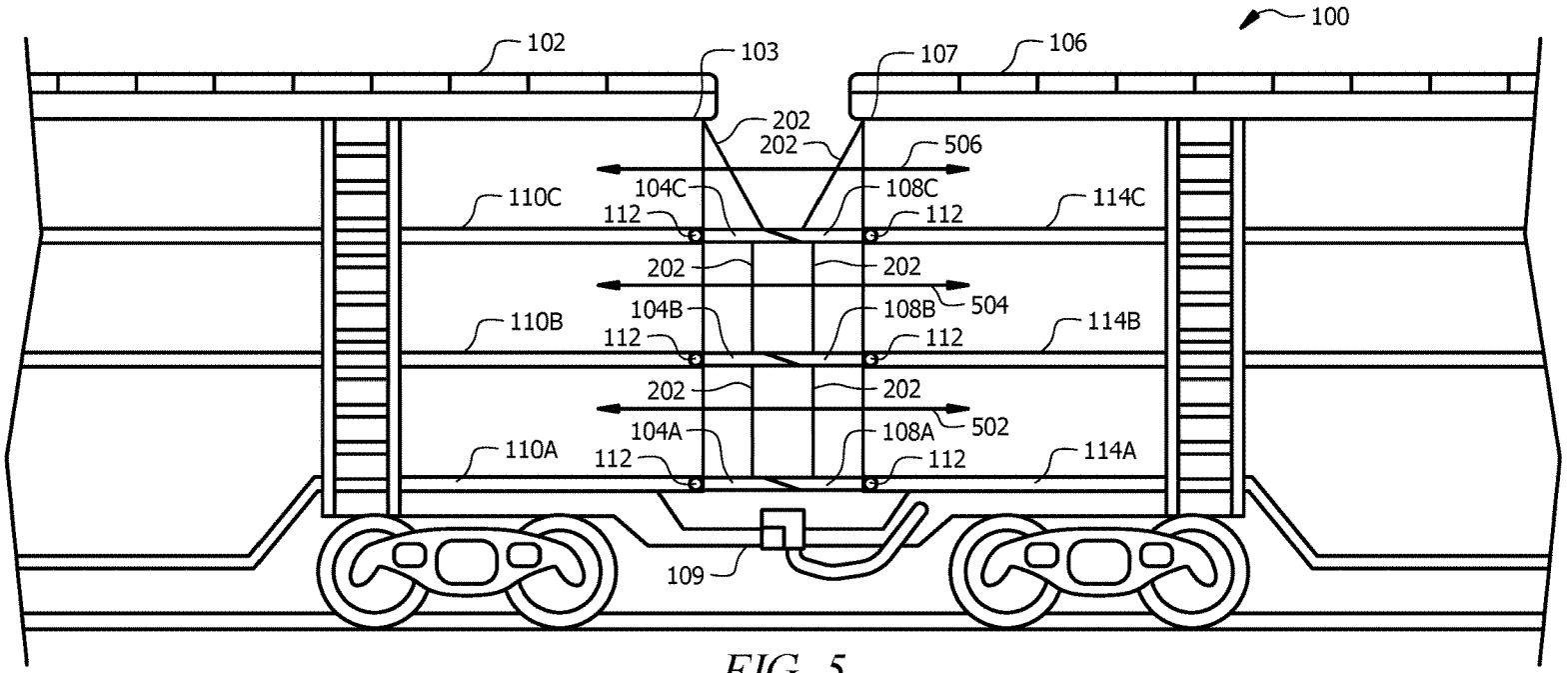
FIG. 5 is a cutaway side view of an embodiment of the first railcar with the first plurality of end doors in the horizontal orientation and the second railcar with the second plurality of end doors in the horizontal orientation.

FIG. 5 is a cutaway side view of an embodiment of the first railcar 102 with the first plurality of end doors 104A-104C in the horizontal orientation and the second railcar 106 with the second plurality of end doors 108A-108C in the horizontal orientation. In FIG. 5, a path is formed between the first plurality of decks 110A-110C of the first railcar 102 and the second plurality of decks 114A-114C of the second railcar 106 when the first railcar 102 is configured with the first plurality of end doors 104A-104C in the horizontal orientation and the second railcar 106 is configured with the second plurality of end doors 108A-108C in the horizontal orientation.

A first end door 104A is configured to allow access to a first deck 110A of the first railcar 102 and to form a portion of a first path 502 between the first deck 110A of the first railcar 102 and a second deck 114A of the second railcar 106 when the first end door 104A is in its horizontal orientation. A second end door 108A is configured to allow access to the second deck 114A of the second railcar 106 and to form a portion of the first path 502 between the second deck 114A of the second railcar 106 and the first deck 110A of the first railcar 102 when the second end door 108A is in its horizontal orientation. The first end door 104A and the second end door 108A are configured to at least partially overlap and/or align when the first end door 104A and the second end door 108A are in their horizontal orientation. For example, the first end door 104A may have a beveled edge configured to interface with a beveled edge of the second end door 108A of the second railcar 106 such that the first end door 104A and the second end door 108A at least partially overlap and/or align when the first end door 104A and the second end door 108A are in their horizontal orientation.

A third end door 104B is configured to allow access to a third deck 110B of the first railcar 102 and to form a portion of a second path 504 between the third deck 110B of the first railcar 102 and a fourth deck 114B of the second railcar 106 when the third end door 104B is in its horizontal orientation. A fourth end door 108B is configured to allow access to the fourth deck 114B of the second railcar 106 and to form a portion of the second 504 path between the fourth deck 114B of the second railcar 106 and the third deck 110B of the first railcar 102 when the fourth end door 108B is in its horizontal orientation. The third end door 104B and the fourth end door 108B are configured to at least partially overlap and/or align when the third end door 104B and the fourth end door 108B are in their horizontal orientation. For example, the third end door 104B may have a beveled edge configured to interface with a beveled edge of the fourth end door 108B of the second railcar 106 such that the third end door 104B and the fourth end door 108B at least partially overlap and/or align when the third end door 104B and the fourth end door 108B are in their horizontal orientation.

A fifth end door 104C is configured to allow access to a fifth deck 110C of the first railcar 102 and to form a portion of a third path 506 between the fifth deck 110C of the first railcar 102 and a sixth deck 114C of the second railcar 106 when the fifth end door 104C is in its horizontal orientation. A sixth end door 108C is configured to allow access to the sixth deck 114C of the second railcar 106 and to form a portion of the third path 506 between the sixth deck 114C of the second railcar 106 and the fifth deck 110C of the first railcar 102 when the sixth end door 108C is in its horizontal orientation. The fifth end door 104C and the sixth end door 108C are configured to at least partially overlap and/or align when the fifth end door 104C and the sixth end door 108C are in their horizontal orientation. For example, the fifth end door 104C may have a beveled edge configured to interface with a beveled edge of the sixth end door 108C of the second railcar 106 such that the fifth end door 104C and the sixth end door 108C at least partially overlap and/or align when the fifth end door 104C and the sixth end door 108C are in their horizontal orientation.

Figure 6:
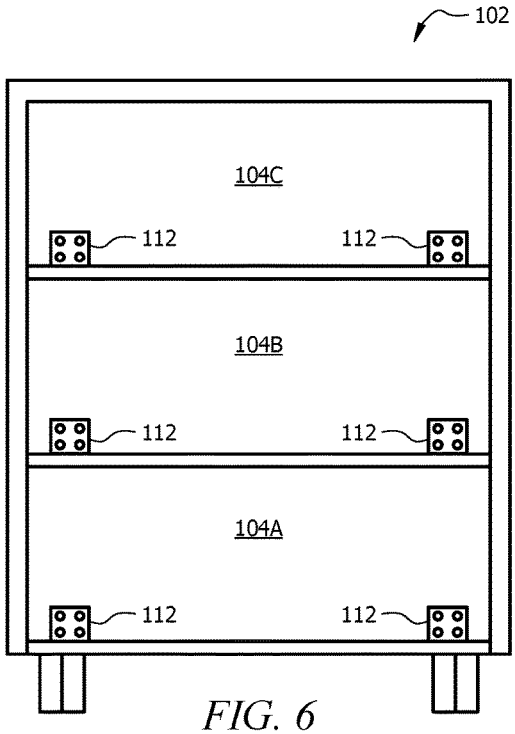
FIG. 6 is an end view of an embodiment of the first railcar with end doors in their vertical orientation.

FIG. 6 is an end view of an embodiment of the first railcar 102 with end doors 104A, 104B, and 104C in their vertical orientation. In some embodiments, the end doors 104A-104C may be replacement end doors for existing end doors of the first railcar 102. For example, the first railcar 102 may be initially configured with a pair of vertically upright end doors (e.g. radial end doors). The pair of vertically upright end doors may be removed and replaced by the end doors 104A-104C.

In some embodiments, the end doors 104A-104C may be add-on doors for existing end doors of the first railcar 102. For example, the first railcar 102 may be configured such that when the end doors 104A-104C are in their vertical orientation a pair of vertically upright end doors may enclose the end doors 104A-104C when the vertically upright end doors are closed. In such a configuration, the pair of vertically upright end doors may provide addition protection and sealing capabilities to the first railcar 102. In some embodiments, the end doors 104A-104C may be configured to be on the exterior of a pair of vertically upright doors such that the end doors 104A-104C enclose the pair of vertically upright end doors when the end doors 104A-104C are in their vertical orientation.

Figure 7:
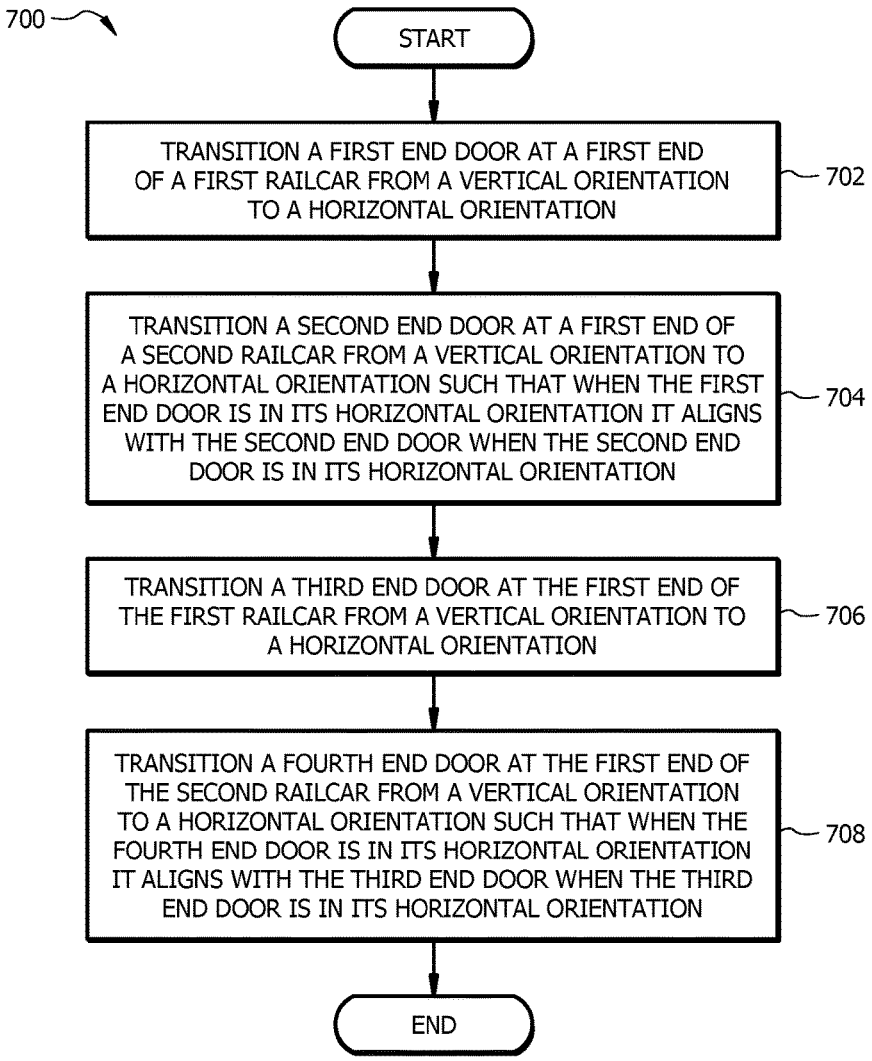
FIG. 7 is a flowchart of an embodiment of a railcar configuring method.

FIG. 7 is a flowchart of an embodiment of a railcar configuring method 700. In one embodiment, an operator may employ method 700 to configure the first railcar 102 and the second railcar 106 to provide paths between one or more decks of the first plurality of decks 110A-110C on the first railcar 102 and one or more decks of the second plurality of decks 114A-114C on the second railcar 106 using the first plurality of end doors 104A-104C and the second plurality of end doors 108A-108C as bridge plates.

At step 702, the operator transitions a first end door (e.g. end door 104A) from the first plurality of end doors 104A-104C at the first end 103 of the first railcar 102 from the vertical orientation to the horizontal orientation. Transitioning the first end door from the vertical orientation to the horizontal orientation may allow access to a first deck (e.g. deck 110A) of the first railcar 102 and may form a portion of a first path between the first railcar 102 and the second railcar 106.

At step 704, the operator transitions a second end door (e.g. end door 108A) from the second plurality of end doors 108A-108C at the first end 107 of the second railcar 106 from the vertical orientation to the horizontal orientation such that when the first end door is in its horizontal orientation it aligns or at least partially overlaps with the second end door when the second end door is in its horizontal orientation. In one embodiment, the operator may adjust the length 105 of the first end door and/or the second end door when the first end door or the second end door is a telescopic end door with an adjustable length 105. For example, the operator may adjust the length 105 of the first end door and/or the second end door to reduce or eliminate any gaps between the first end door and the second end door when the first end door and the second end door are in their horizontal orientation. Transitioning the second end door from the vertical orientation to the horizontal orientation may allow access to a second deck (e.g. deck 114A) of the second railcar 106 and may form a portion of the first path between the first railcar 102 and the second railcar 106.

At step 706, the operator transitions a third end door (e.g. end door 104B) from the first plurality of end doors 104A-104C at the first end 103 of the first railcar 102 from the vertical orientation to the horizontal orientation. In one embodiment, the operator may transition third end door from the vertical orientation to the horizontal orientation at about the same time as the first end door transitions from the vertical orientation to the horizontal. In other embodiments, the first end door and the third end door may each transition from the vertical orientation to the horizontal orientation at different times. Transitioning the third end door from the vertical orientation to the horizontal orientation may allow access to a third deck (e.g. deck 110B) of the first railcar 102 and may form a portion of a second path between the first railcar 102 and the second railcar 106.

At step 708, the operator transitions a fourth end door (e.g. end door 108B) from the second plurality of end doors 108A-108C at the first end 107 of the second railcar 106 from the vertical orientation to the horizontal orientation such that when the third end door is in its horizontal orientation it aligns or at least partially overlaps with the fourth end door when the fourth end door is in its horizontal orientation. In one embodiment, the operator may adjust the length 105 of the third end door and/or the fourth end door when the third end door or the fourth end door is a telescopic end door with an adjustable length 105. For example, the operator may adjust the length 105 of the third end door and/or the fourth end door to reduce or eliminate any gaps between the third end door and the fourth end door when the third end door and the fourth end door are in their horizontal orientation. In one embodiment, the operator may transition fourth end door from the vertical orientation to the horizontal orientation at about the same time as the second end door transitions from the vertical orientation to the horizontal. In other embodiments, the second end door and the fourth end door may each transition from the vertical orientation to the horizontal orientation at different times. Transitioning the fourth end door from the vertical orientation to the horizontal orientation may allow access to a fourth deck (e.g. deck 114B) of the second railcar 106 and may form a portion of the second path between the first railcar 102 and the second railcar 106.

In other embodiments, the process of transitioning end doors on the first railcar 102 and corresponding adjacent doors on the second railcar 106 from the vertical orientation to the horizontal orientation may be repeated for additional end doors.

Figure 8:
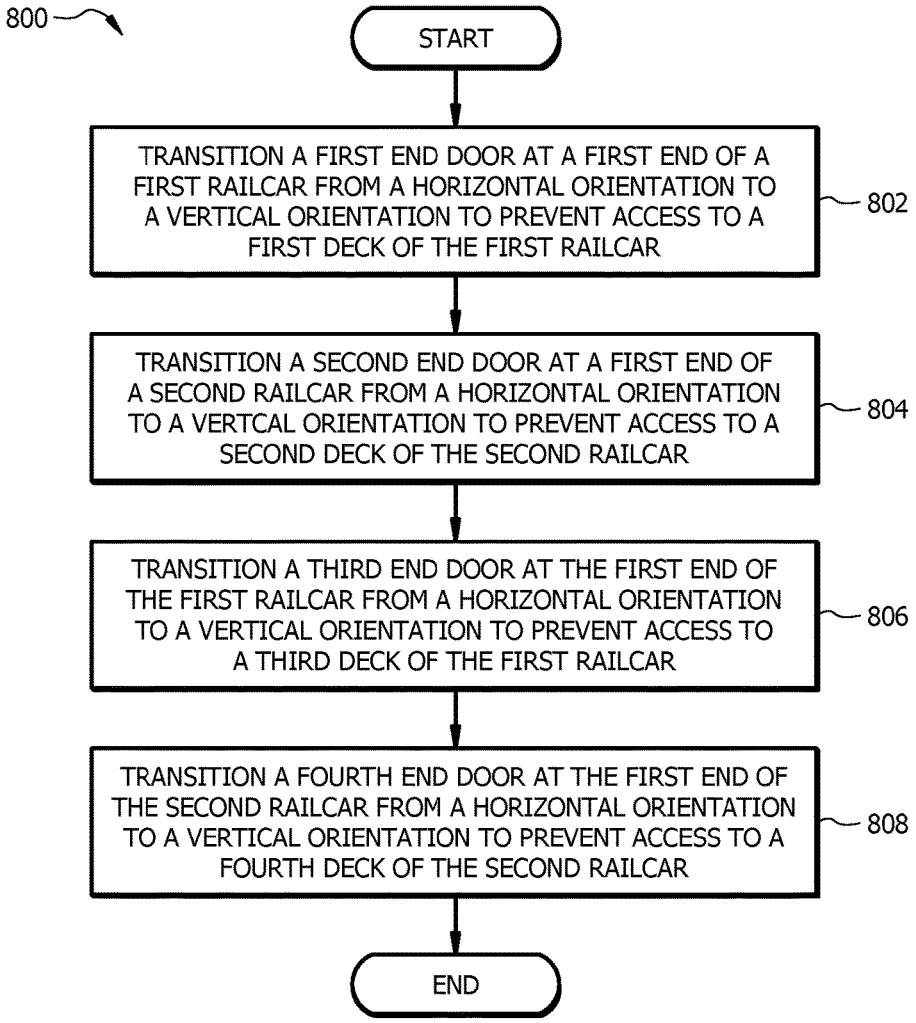
FIG. 8 is a flowchart of another embodiment of a railcar configuration method.

FIG. 8 is a flowchart of another embodiment of a railcar configuration method 800. In one embodiment, an operator may employ method 800 to configure first railcar 102 and the second railcar 106 to remove paths between adjacent decks of the first railcar 102 and the second railcar 106. For example, method 800 may be employed following configuring the first railcar 102 and the second railcar 106 to provide paths between the first railcar 102 and the second railcar 106 using a method such as method 700.

At step 802, the operator transitions a first end door at a first end door (e.g. end door 104B) of the first railcar 102 from a horizontal orientation to a vertical orientation to prevent access to a first deck (e.g. deck 110B) of the first railcar 102.

At step 804, the operator transitions a second end door at a first end door (e.g. end door 108B) of the second railcar 106 from a horizontal orientation to a vertical orientation to prevent access to a second deck (e.g. deck 114B) of the second railcar 106. Transitioning the first end door and the second end door from the horizontal orientation to the vertical orientation removes the path that connects the first deck of the first railcar 102 and the second deck of the second railcar 106.

At step 806, the operator transitions the operator transitions a third end door at the first end door (e.g. end door 104A) of the first railcar 102 from a horizontal orientation to a vertical orientation to prevent access to a second deck (e.g. deck 110A) of the first railcar 102.

At step 808, the operator transitions a fourth end door at the first end door (e.g. end door 108A) of the second railcar 106 from a horizontal orientation to a vertical orientation to prevent access to a fourth deck (e.g. deck 114A) of the second railcar 106. Transitioning the third end door and the fourth end door from the horizontal orientation to the vertical orientation removes the path that connects the third deck of the first railcar 102 and the fourth deck of the second railcar 106.

In other embodiments, the process of transitioning end doors on the first railcar 102 and corresponding adjacent doors on the second railcar 106 from the horizontal orientation to the vertical orientation may be repeated for additional end doors.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. §112(f) as it exists on the date of filing hereof unless the words "means for" or "step for" are explicitly used in the particular claim.

The invention claimed is:

1. A railcar system comprising:

a first railcar comprising:

a first plurality of decks disposed at different levels within the first railcar; and a first plurality of end doors disposed at a first end of the first railcar, wherein:

each of the first plurality of end doors is adjacent to a respective deck of the first plurality of decks, and each of the plurality of first end doors is configurable between a vertical orientation and a horizontal orientation such that each of the first plurality of end doors aligns with its respective deck of the first plurality of decks when in its horizontal orientation;

a second railcar comprising:

a second plurality of decks disposed at different levels within the second railcar;

a second plurality of end doors disposed at a first end of the second railcar, wherein:

each of the second plurality of end doors is adjacent to a respective deck of the second plurality of decks, and each of the second plurality of end doors is configurable between a vertical orientation and a horizontal orientation such that each of the second plurality of end doors aligns with its respective deck of the second plurality of decks when in its horizontal orientation; and wherein when a first end door of the first plurality of end doors of the first railcar is in its horizontal orientation it aligns with a second end door of the second plurality of end doors of the second railcar when the second end door is in its horizontal orientation; and wherein when a third end door of the first plurality of end doors of the first railcar is in its horizontal orientation it aligns with a fourth end door of the second plurality of end doors of the second railcar when the fourth end door is in its horizontal orientation.

2. The system of claim 1, wherein when a fifth end door of the first plurality of end doors of the first railcar is in its horizontal orientation it aligns with a sixth end door of the second plurality of end doors of the second railcar when the sixth end door is in its horizontal orientation.

3. The system of claim 1, wherein:

the railcar system is configurable between a first configuration and a second configuration, all of the first plurality of end doors and all of the second plurality of end doors are configured in the vertical orientation when the railcar system is in the first configuration, and at least one of the first plurality of end doors and at least one of the second plurality of end doors are configured in the horizontal configuration and align with each other when the railcar system is in the second configuration.

4. The system of claim 1, wherein:

each of the first plurality of end doors is operably coupled to the first railcar using a first set of support attachments; and each of the second plurality of end doors is operably coupled to the second railcar using a second set of support attachments.

5. The system of claim 1, wherein:

each of the first plurality of end doors is operably coupled to at least one other end door from the first plurality of end doors using a first set of support attachments; and each of the second plurality of end doors is operably coupled to at least one other end door from the second plurality of end doors using a second set of support attachments.

6. The system of claim 1, wherein:

the plurality of first decks has two decks; and the plurality of second decks has two decks.

7. The system of claim 1, wherein:

the plurality of first decks has three decks; and the plurality of second decks has three decks.

8. The system of claim 1, wherein at least one of the first plurality of end doors is a telescopic end door, wherein the length of telescopic end door is adjustable.

9. The system of claim 1, wherein the first plurality of end doors are configured to transition between the vertical orientation and the horizontal orientation at the same time.

10. The system of claim 1, wherein the first plurality of end doors are configured to transitions between the vertical orientation and the horizontal orientation individually.

* * * * *